US011299340B2

(12) United States Patent
Bisio

(10) Patent No.: US 11,299,340 B2
(45) Date of Patent: Apr. 12, 2022

(54) CAPSULE FOR THE PREPARATION OF INFUSED OR SOLUBLE BEVERAGES

(71) Applicant: BISIO PROGETTI S.p.A., Alessandria (IT)

(72) Inventor: Luigi Bisio, Alessandria (IT)

(73) Assignee: BISIO PROGETTI S.P.A, Alessandria (IT)

( * ) Notice: Subject to any disclaimer, the term of this patent is extended or adjusted under 35 U.S.C. 154(b) by 197 days.

(21) Appl. No.: 16/079,168

(22) PCT Filed: Sep. 28, 2016

(86) PCT No.: PCT/IB2016/055799
§ 371 (c)(1),
(2) Date: Aug. 23, 2018

(87) PCT Pub. No.: WO2016/193961
PCT Pub. Date: Dec. 8, 2016

(65) Prior Publication Data

US 2019/0023482 A1 Jan. 24, 2019

(30) Foreign Application Priority Data

Mar. 4, 2016 (IT) ..... 102016000022783

(51) Int. Cl.
*B65D 85/804* (2006.01)

(52) U.S. Cl.
CPC ..... *B65D 85/8055* (2020.05); *B65D 85/8061* (2020.05)

(58) Field of Classification Search
CPC .... A47J 31/0652; A47J 31/3623; A47J 31/46; B65D 85/8043; B65D 85/8055
(Continued)

(56) References Cited

U.S. PATENT DOCUMENTS 4,077,551 A * 3/1978 Manaresi ..... B65D 85/8043 206/221
5,402,707 A * 4/1995 Fond ..... A47J 31/0678 99/295

(Continued)

FOREIGN PATENT DOCUMENTS

CN 104768857 A 7/2015
CN 105050922 A 11/2015

(Continued)

OTHER PUBLICATIONS

International Search Report and Written Opinion for PCT/IB2016/055799 dated Jan. 23, 2017.

*Primary Examiner* — Ibrahime A Abraham
*Assistant Examiner* — Chris Q Liu
(74) *Attorney, Agent, or Firm* — Thomas | Horstemeyer, LLP.

(57) ABSTRACT

A capsule (1) for the preparation of infused or soluble beverages comprises a cup (2) suitable to contain a substance (11) to be infused or dissolved, provided internally with a base (33) provided with an outer edge (360) and a relief (320) between which is defined a depression (330) for the collection of the infused beverage. The capsule (1) comprises a disc (5) fixed in a peelable manner on the edge (360) so as to separate from it due to the effect of the pressure increase inside the capsule (1). The opening of the capsule (1) occurs as a result of the deformation of the disc (5) due to the pressure exerted by the fluid inside the capsule (1). Advantageously, the base (33), in correspondence of the depression (330), is provided with a plurality of supports (90, 91, 92) provided with a profile decreasing towards the depression (330), suitable to prevent the deformation of the disc (5) from interfering with the outflow of the beverage towards the opening (31).

15 Claims, 13 Drawing Sheets

(58) Field of Classification Search
USPC ..... 99/295, 300; 426/425, 595; 222/478, 222/481; 414/806
See application file for complete search history.

(56) References Cited

U.S. PATENT DOCUMENTS

| | | | | |
|---|---|---|---|---|
| 2008/0264267 | A1* | 10/2008 | Doglioni Majer . | B65D 85/8043 99/295 |
| 2010/0180775 | A1* | 7/2010 | Kollep ..... | B65D 85/8043 99/295 |
| 2010/0260896 | A1 | 10/2010 | Yoakim et al. | |
| 2010/0307930 | A1 | 12/2010 | Zangerle | |
| 2011/0005399 | A1* | 1/2011 | Epars ..... | B65D 85/8043 99/295 |
| 2011/0236541 | A1* | 9/2011 | Gerbaulet ..... | A47J 31/22 426/106 |
| 2012/0100259 | A1 | 4/2012 | Rapparini | |

FOREIGN PATENT DOCUMENTS

| | | | |
|---|---|---|---|
| WO | 9507648 | A1 | 3/1995 |
| WO | 2008116818 | A1 | 10/2008 |
| WO | 2009115475 | A1 | 9/2009 |
| WO | 2012100976 | A1 | 8/2012 |
| WO | 2015121881 | A1 | 8/2015 |
| WO | 2015121882 | A1 | 8/2015 |

* cited by examiner

CAPSULE FOR THE PREPARATION OF INFUSED OR SOLUBLE BEVERAGES

CROSS-REFERENCE TO RELATED APPLICATION

This application is the 35 U.S.C. § 371 national stage application of PCT Application No. PCT/IB2016/055799, filed Sep. 28, 2016, where the PCT claims the priority to and benefit of Italian Patent Application No. 102016000022783, filed Mar. 4, 2016, both of which are herein incorporated by reference in their entireties.

This invention relates to a capsule for the preparation of infused or soluble beverages.

In particular, this invention relates a capsule for the packaging of concentrated products (for example in the form of powder, granules or leaves) in predetermined and disposable doses, for the extemporaneous preparation. of beverages (such as tea, coffee, herbal tea, milk, chocolate, etc.) by means of the introduction, into the capsule itself, of a fluid under pressure (mostly hot water).

In the field of capsules or pods for coffee or other infusions, it is known to use automatic or semi-automatic machines equipped with a dispenser group suitable to produce an infusion through the passage of hot water under pressure through the capsule containing precisely the essence to be infused or dissolved.

To prevent the pressurised fluid from passing through the substance to be infused too rapidly, without therefore spreading sufficiently inside the capsule with negative repercussions on the quality of the infused beverage, the known capsules are provided with a layer of sealing film, placed on the bottom of the capsule in correspondence of a base provided with one or more cutting or piercing points or profiles. The increase of pressure in the capsule causes the pressurised fluid to push the aluminium layer against the points on the base until it is pierced or ruptured. Once the opening is created in the layer of aluminium, the infused beverage can flow out from a suitable opening in the base of the capsule itself.

These known capsules are rather complex from the constructive point of view, particularly as regards the realisation of the cutting and piercing points and profiles on the base. Therefore, these known capsules are rather expensive, especially as concerns the production of the related moulds.

The purpose of this invention is to provide a capsule for the preparation of infused or soluble beverages that solves the problems of the prior art while taking into account the needs of the sector.

In particular, the purpose of this invention is to provide a capsule in which the opening to allow the outflow of the infused beverage occurs as a result of the deformation of a sealing disc placed to cover the bottom of the capsule due to the pressure exerted by the fluid under pressure inside it, and wherein the deformation does not interfere with the outflow of the drink passing towards the outlet nozzle, and thus allows a correct and complete outflow of the infused beverage.

This purpose is achieved by a capsule for the preparation of infused or soluble beverages according to claim 1. The dependent claims describe preferred embodiments of the invention.

The characteristics and advantages of a capsule for the preparation of infused or soluble beverages according to this invention will be apparent from the following description, given by way of non-limiting example, in accordance with the accompanying figures, wherein.

The accompanying figures represent a capsule for the preparation of infused or soluble beverages indicated with the reference number 1.

The capsule 1 comprises a body or cup 2 suitable to define an internal volume V for containing at least one substance 11 to be infused or dissolved, typically in powder or granular form.

The cup 2 is made of plastic material, preferably injection moulded or thermoformed.

Figure 1:
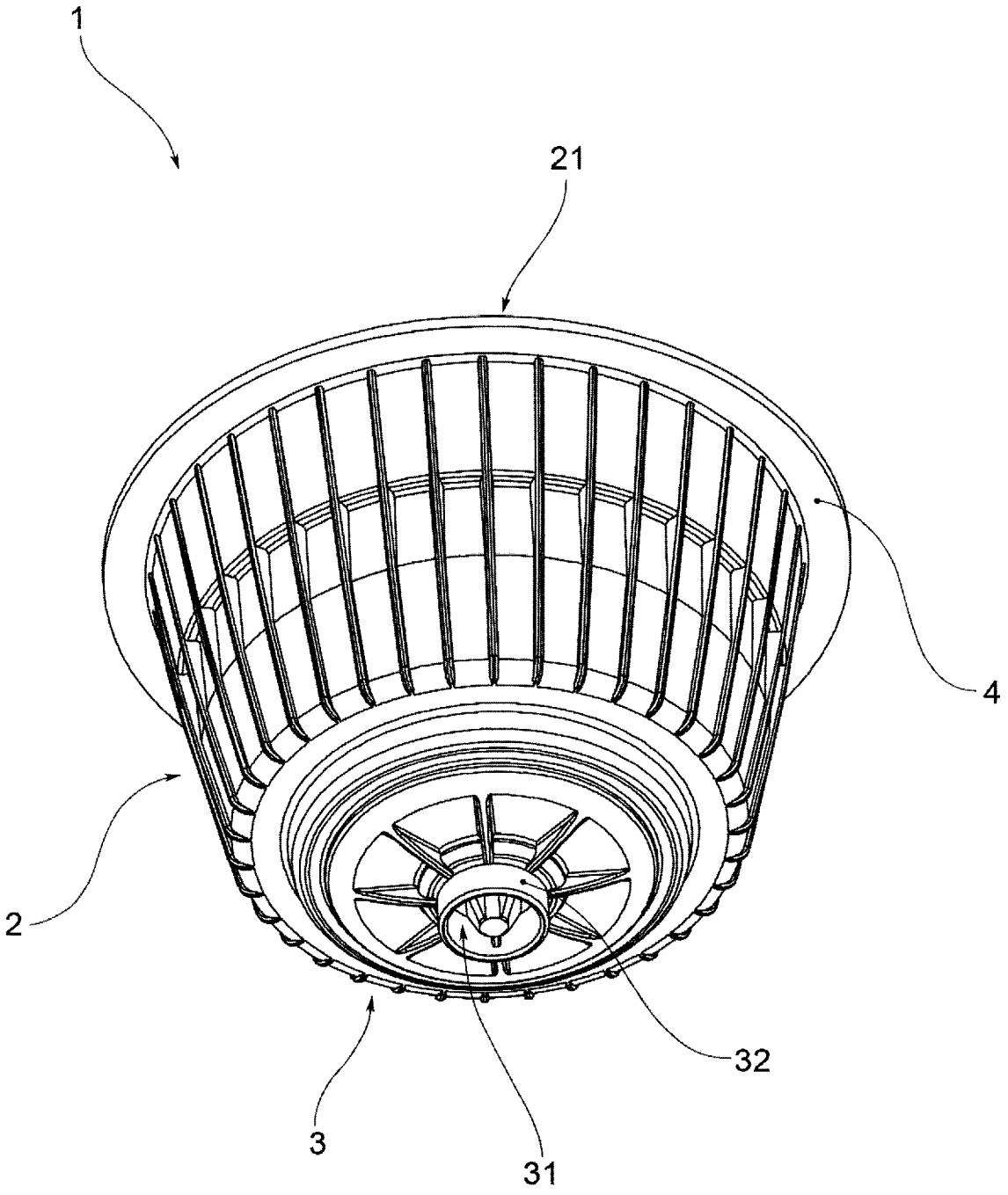
FIG. 1 is a perspective view from below of a capsule for the preparation of infused or soluble beverages according to this invention.
Figure 2:
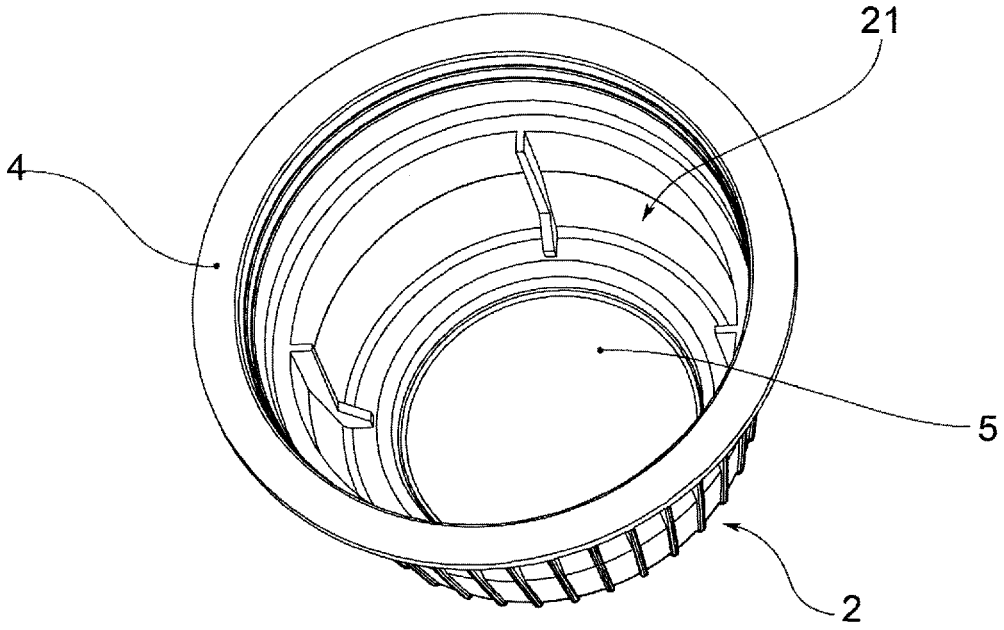
FIG. 2 is a perspective view from above of a capsule provided internally with a sealing disc placed on the bottom, according to this invention, before infusion.

As shown in FIGS. 1 and 2, the cup 2 is provided, on one side, with a bottom 3 and, on the opposite side, an entrance opening 21 defined by an edge 4 protruding outwardly.

Figure 4:
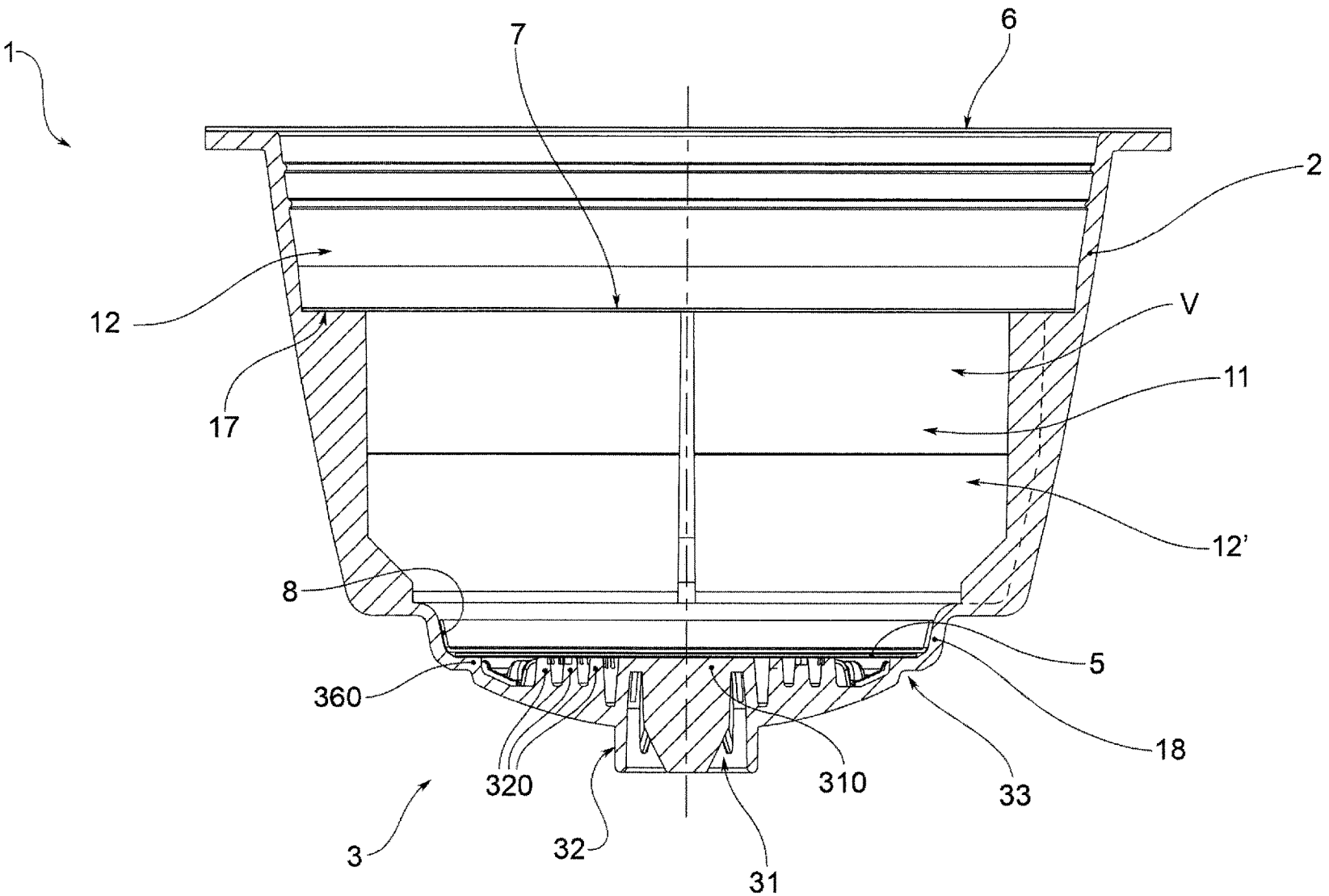
FIGS. 4 and 5 shows a sectional view of a capsule provided internally with a sealing disc placed on the bottom, according to this invention, respectively before and after infusion.
Figure 5:
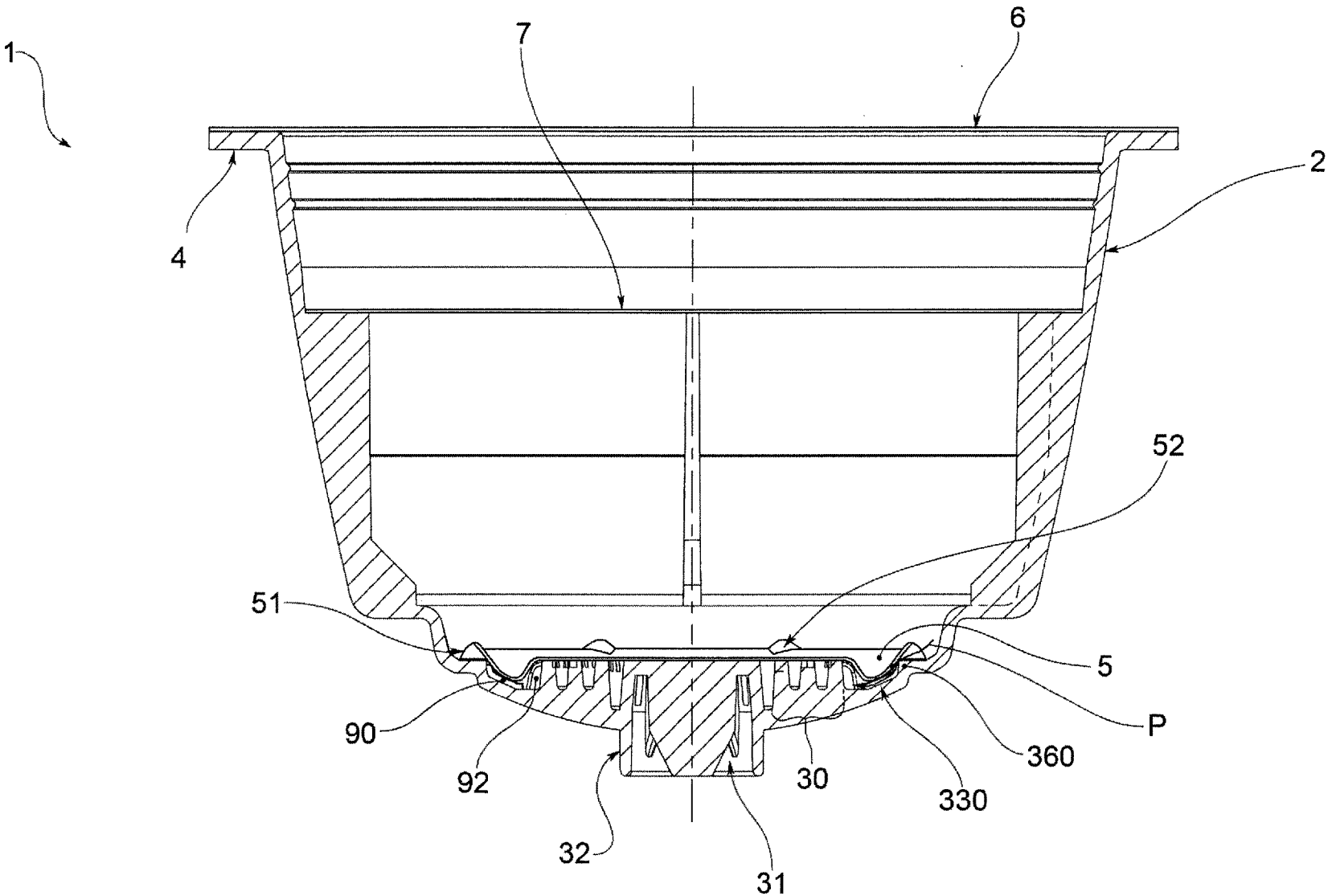

As shown in FIGS. 4 and 5, the capsule 1 comprises a cover 6 fixed, by gluing or welding, in correspondence of the upper edge 4, suitable to seal the cup 2 on the top.

The cup 2 is provided, externally, in correspondence of the bottom 3, with an exit opening 31, defined by a nozzle 32, suitable to allow the outflow of the infused beverage.

The cup 2 is provided internally, in correspondence of the bottom 3, with an internal base 33 provided with a plurality of reliefs 310,320,360, protruding vertically with respect to the base 33 itself. The reliefs are protruding towards the inside of the cup 2, in the direction of the cover 6. Advantageously, the upper surface of the reliefs 310,320,360 is substantially flat and free of cutting, puncturing or lacerating elements.

Figure 13:
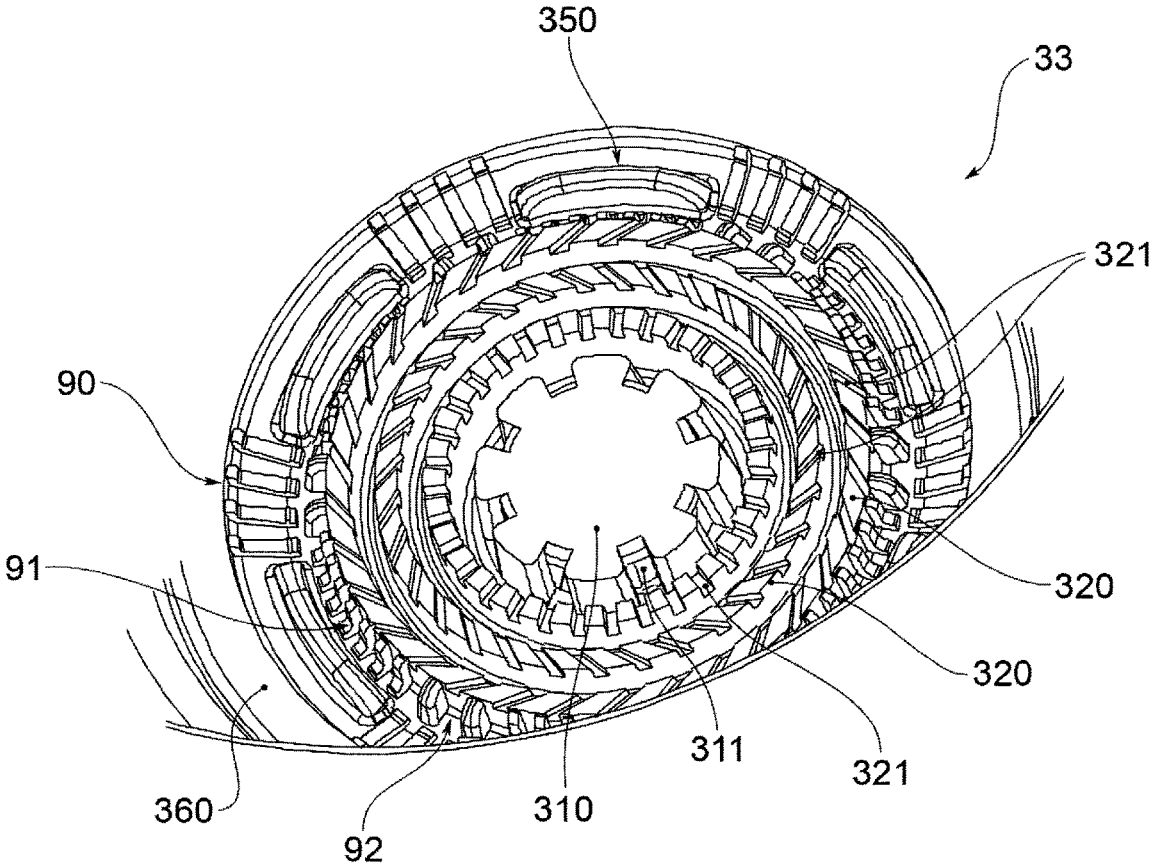
FIG. 13 shows an enlargement of the bottom of the capsule of FIG. 12.
Figure 14:
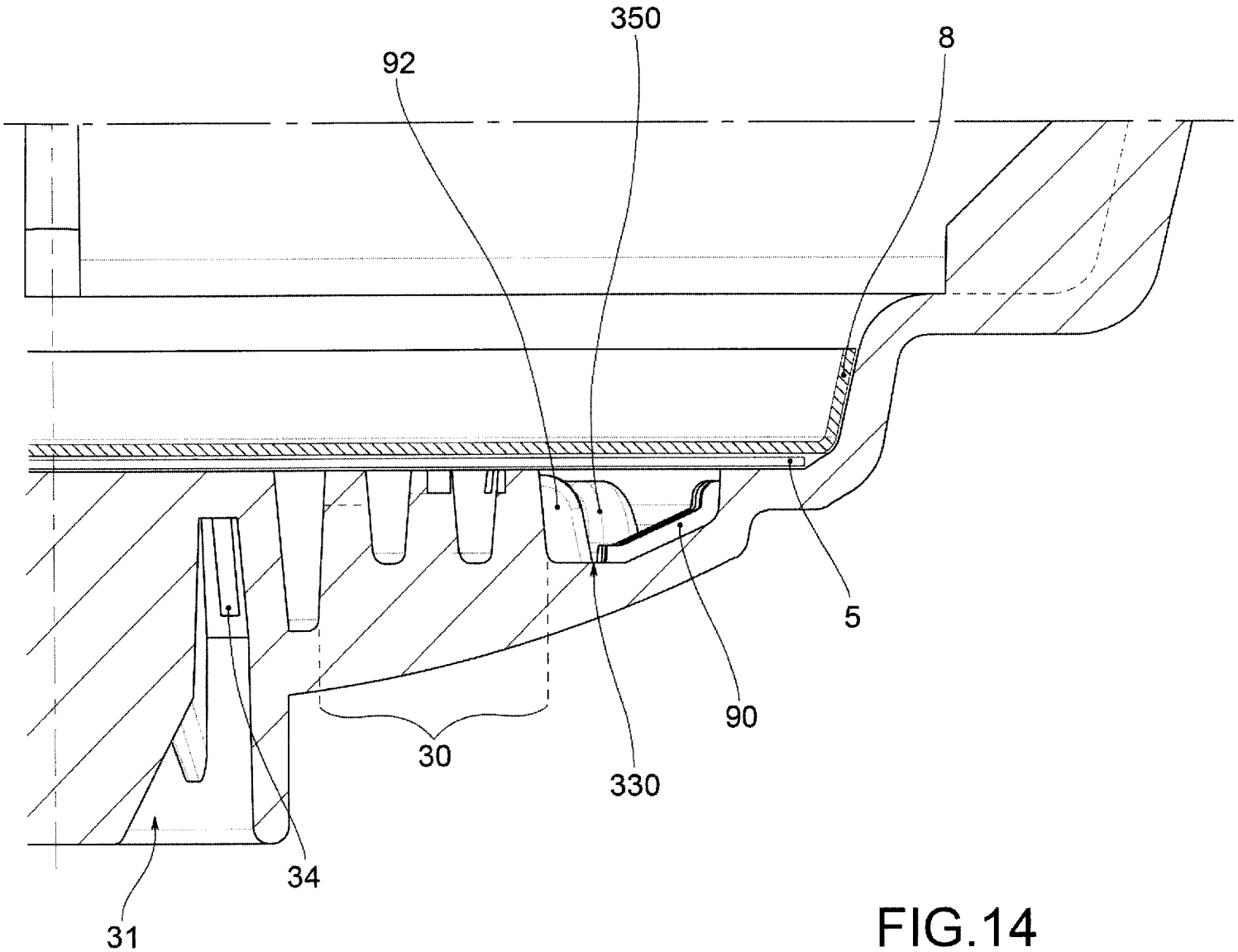
FIG. 14 shows a sectional view of a detail of the bottom of the capsule of FIG. 12.

As shown in FIGS. 4 and 13, the base 33 comprises a central portion 310, defined by a first relief, covering the exit opening 31 of the nozzle 32. The central portion 310 is provided with at least one connection opening 311 between the inside of the cup 2 and the exit opening 31, precisely to allow the outflow of the infused beverage to the outside of the capsule 1. Preferably, the central portion 310 comprises a plurality of connection openings 311.

As shown for example in FIG. 5, the base 33 comprises a labyrinth 30 suitable to prevent, by effect of capillarity, the passage of the infused beverage to the nozzle 32 when the pressure inside the capsule 1 drops below a threshold value, or ceases altogether when the capsule 1 is disengaged from the infusing group of the machine.

The labyrinth 30 is defined by at least one further relief, said labyrinth portion 320. In the embodiments shown in the figures, the labyrinth 30 is defined by three labyrinth portions 320.

Preferably, the labyrinth portion 320 is of substantially circular shape, arranged concentrically with respect to the nozzle 32 (and to the central portion 310).

The labyrinth portion 320 is provided with a plurality of grooves 321, preferably provided on the upper surface of the relief, for the outflow of the infused beverage to the outside of the capsule 1.

The base 33 comprises an outer edge 360, defined by a further relief, on which a sealing disc 5 is fixed in a partially releasable manner, which is to say in a peelable manner, by gluing or welding.

Preferably, the relief 360 that defines the edge 360 has substantially the same vertical extension of the other reliefs 310,320 that form the base 33.

The capsule 1 is internally provided with a sealing disc 5 placed in correspondence of the base 33 and suitable to seal the cup 2 inferiorly. The capsule 1 is thus provided with a closed chamber 12, defined by the cover 6 on the top and by the disc 5 on the bottom, inside which is contained the substance 11 to be infused or dissolved. The presence of a hermetically closed chamber 12 is important for the good maintenance and preservation of the substance 11.

As shown in FIG. 4, the disc 5 is positioned between the internal volume V and the reliefs 310,320,360, between the substance 11 and above the base 33. The disc 5 closes the containment volume V of the substance, resting on the reliefs 310,320,360 that form the base 33.

The disc 5 is internally fixed to the cup 2, in correspondence of the base 33, in a manner at least partially releasable or peelable. In particular, the disc 5 is glued or welded in a mild, namely peelable, manner at least on the upper surface of the relief 360 that defines the outermost edge of the base 33. In particular, the disc 5 is fixed in such a way as to allow its detachment or unsticking from the base 33, and in particular from the edge 360, due to the increase of pressure inside the capsule 1.

The disc 5 is glued in a peelable manner on the outer edge 360. Preferably, the disc 5 is also glued on the labyrinth 30, namely on the reliefs 320.

The disc 5 is made of plastic material, multi-layer or single layer, or aluminium, or a composite plastic/aluminium material.

In the case of a disc 5 made of plastic material, the disc is preferably multilayer. In the case of a multilayer plastic disc 5, the lower layer that will be fixed to the base 33 is made of a material compatible with the material of the cup 2, so as to allow the welding, albeit mild. For example, for a capsule 1 made of plastic with cup 2 made of polypropylene, the lower layer of the disc 5 is made of polypropylene, preferably peelable polypropylene. This solution allows obtaining a capsule 1 completely made of plastic and thus more easily recyclable.

In the case of a disc 5 made of aluminium, the disc 5 is fixed to the base 33 using a glue or lacquer with a low or mild level of adhesion.

The capsule 1 can be realised in different versions, for example for the preparation of infusion beverages (such as coffee) or of soluble beverages.

FIGS. 4 and 5 show a capsule for the preparation of coffee.

Preferably, the capsule 1 comprises a fixed filter 8, below the substance 11 in correspondence of the inner walls of the cup 2, just above the disc 5. The presence of the filter 8, preferably made of paper or nonwoven fabric, is used to filter the infusion liquid before it flows out of the capsule 1.

Preferably, the capsule 1 for coffee also comprises a permeable or micro-perforated film 7, fixed at a certain distance above the substance 11 on special horizontal abutments 17 provided inside the cup 2. The presence of this film 7, which allows the passage of the pressurised fluid but not the passage of the substance 11, prevents the dispersion of the coffee powder during the infusion step, improving the quality of the infused beverage.

In the case of a capsule for the preparation of soluble beverages, such for example chocolate or milk, the capsule 1 comprises the cover 6 and the sealing disc 5, and is without the filter 8 and the permeable or micro-perforated film 7.

The capsule 1, in its various embodiment variants, is usable for the extemporaneous preparation of beverages (such as tea, coffee, herbal tea, milk, chocolate, etc.) using automatic or semi-automatic machines equipped with a dispenser group suitable to produce an infusion through the passage of hot water under pressure through the capsule 1.

So, in use, the capsule 1 (FIG. 4) is inserted in a suitable seat (said infusion chamber) provided in the machine. The machine pierces the cover 6, placed to close the capsule 1, and inserts, inside the chamber 12,12' in which the substance 11 is contained, a pressurised fluid (mostly hot water).

Figure 3:
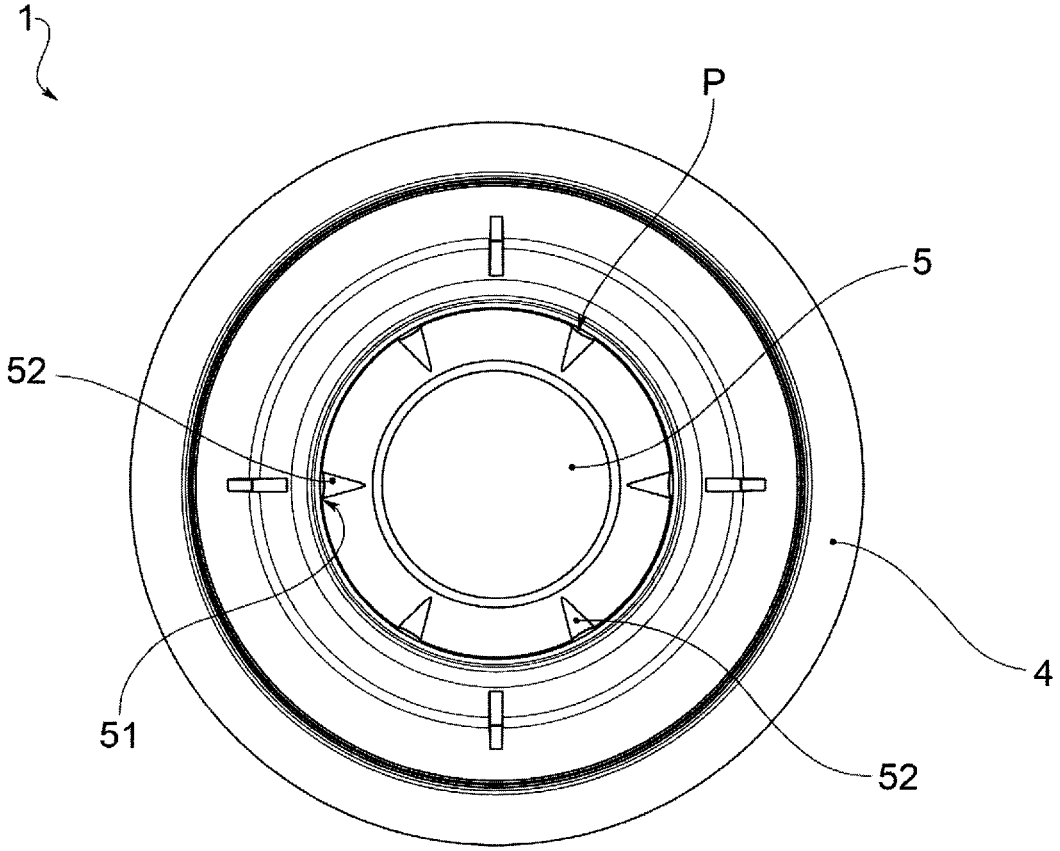
FIG. 3 shows a view from above of the capsule of FIG. 2 after infusion.

The presence of the disc 5 to closure of the bottom 3 of the capsule 1 allows the pressurised fluid to remain, for a certain interval of time, in contact with the substance 11 to be infused or dissolved, so as to ensure obtaining an optimal infused beverage. The pressure exerted by the fluid inside the capsule 1 rises until reaching the opening pressure (for example comprised between 4 and 8 bar), which pushes on the disc determining the opening of the capsule 1. In particular, as shown in FIGS. 3 and 5, the opening of the capsule 1 is determined by the deformation, at least partial, of the disc 5.

Due to the increase of pressure inside the capsule 1, the disc 5 is deformed: the edge 51 of the disc 5 is raised slightly with respect to the edge 360 of the base 33 and becomes unstuck, at least partially, from the edge 360. The unsticking occurs at least in correspondence of the edge 51 of the disc 5 and the edge 360 of the base 33. This unsticking obviates the sealing effect previously provided by the sealing disc 5.

Always due to the increase of pressure inside the capsule 1, the edge 51 of the disc 5 is deformed with a certain undulation and forms a crease 52, preferably a plurality of creases 52.

The deformation of the disc 5, and in particular the crease 52, determines a separation of the disc 5 from the base 33, at least in correspondence of the edge 360, such as to allow the opening of a passage P for the outflow of the infused liquid.

Between the edge 360 and the labyrinth 30, there is defined, in correspondence of the base 33, a depression 330 suitable to collect the infused beverage and to allow the flow towards the openings 311 of the central portion 310, and from here towards the nozzle 32 and the outside of the capsule 1.

Furthermore, as shown in FIG. 5, the depression 330 provides suitable to accommodate, without obstructing it, the deformation of the disc 5 for the formation of the wrinkles 52.

In the capsule 1 according to this invention, the exit passage P for the infused beverage, between the chamber 12, 12' and the nozzle 32, is created spontaneously by just the increase in pressure exerted by the pressurised fluid in the capsule 1, without the need for means of piercing or tearing of the disc, such as points or cutting profiles.

The disc 5 according to this invention is therefore very elastic to in order to freely deform without tearing. However, the high elasticity means that the disc 5 may be deformed to the point of adhering to the profile of the reliefs 320, 360 of the base 33, which profile may be sharp and cause damage to the disc itself. So, advantageously, the capsule 1 according to this invention is provided, in correspondence of the base 33, with supports suitable to accompany the deformation of the disc 5 in such a way that it does not tear or break.

Advantageously, the supports can be slides 90, steps 91, or ramps 92 and have rounded and bevelled profiles and are thus without sharp corners or cutting profiles.

During deformation, the disc 5 is deformed freely in any free space between the reliefs 310,320,360 of the base 33, until almost adhering to the bottom and thus obstructing the flow of the infused beverage to the openings 311 of the central portion 310. So, advantageously, the supports (slides 90, steps 91, and ramps 92) keep the disk 510 raised during the deformation process in so as not to adhere to the surface of the base 33, and in particular to the bottom surface of the depressions present between the reliefs 310, 320, 360.

As shown in FIG. 13, the slides 90, steps 91, and ramps 92 are arranged inside of the depression 330, between the labyrinth 30 and the edge 360.

Preferably, the supports (slides 90, steps 91, and ramps 92) extend in a radial direction from a relief 360,320 of the base 33. In particular, the supports 90, 91, 92 are provided close to a relief, preferably in contact with a relief 360, 320 of the base 33.

Advantageously, the supports (slides 90, steps 91, and ramps 92) are provided with a profile decreasing toward the depression 330.

Preferably, the supports (slides 90, steps 91, and ramps 92) have a maximum height equal to, or slightly less than, the height of the adjacent relief.

Preferably, the supports (slides 90 and steps 91) have a minimum height of slightly higher than, the bottom of the depression 330.

Preferably, the supports are slides 90 provided close to the edge 360, with a radial extension inside the depression 330, provided with a maximum height slightly less than the height of the edge 360 and a minimum height slightly above the bottom of the depression 330.

Preferably, the supports are steps 91 provided close to the labyrinth 30, with a radial extension inside the depression 330, provided with a maximum height slightly less than the height of the relief 320 and a minimum height slightly above the bottom of the depression 330.

Preferably, the slides 90 are longer than the 91 steps. Preferably, the slides 90 are arranged facing the steps 91. Preferably, the slides 90 are staggered circumferentially with respect to the steps 91.

Preferably, the supports are ramps 92 provided close to the labyrinth 30, with a radial extension inside the depression 330, provided with a maximum height approximately equal to the height of the relief 320.

Preferably, the slides 90 are arranged facing the ramps 92.

Preferably, the slides 90 are staggered circumferentially with respect to the ramps 92. Advantageously, the presence of supports 90,91,92 facing and staggered circumferentially ensures the presence of a flow path for the infused beverage.

Figure 6:
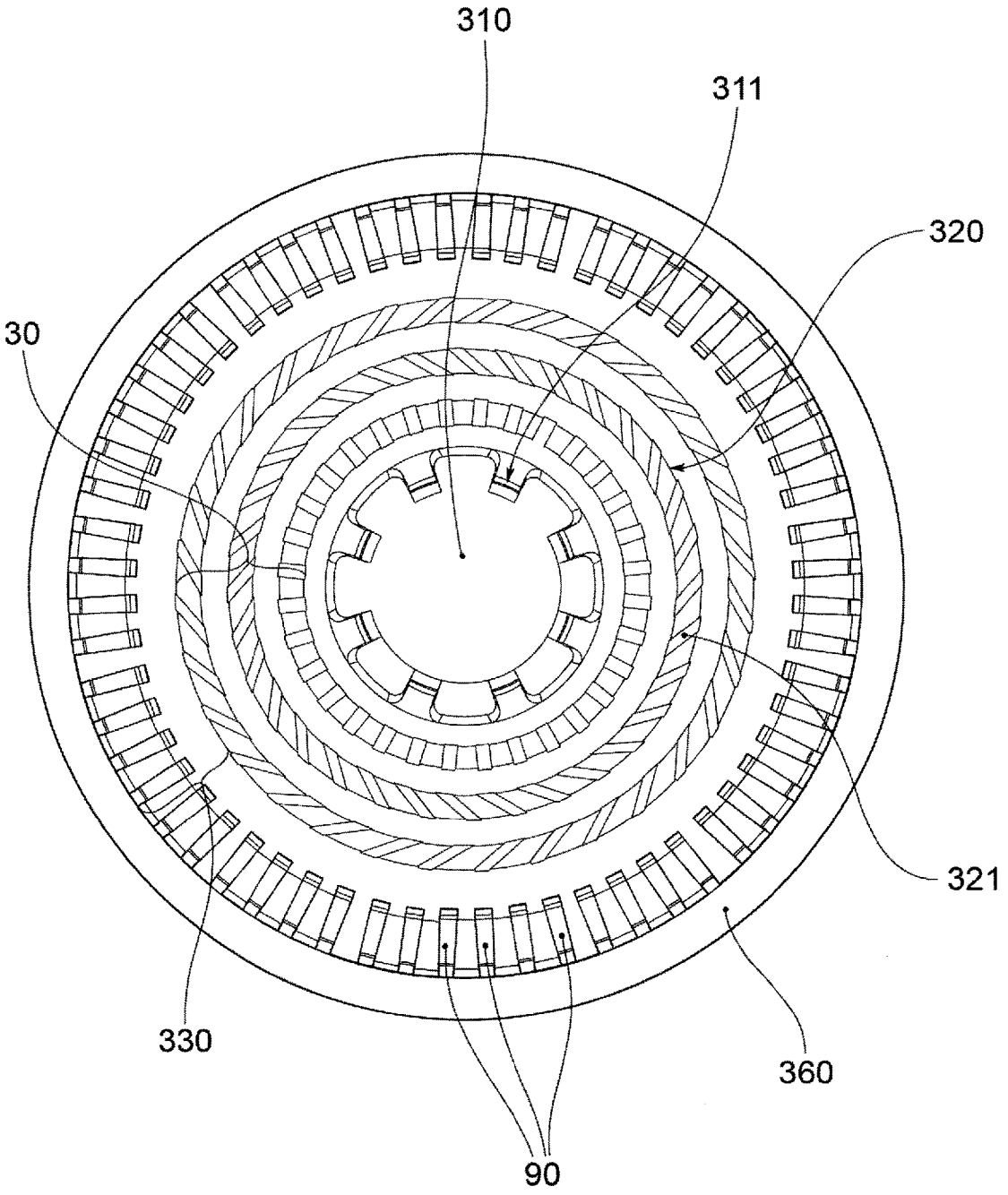
FIG. 6 shows a top view of the internal bottom of a capsule according to this invention, in an embodiment.

In the embodiment variant shown in FIG. 6, the base 33 is provided with a plurality of slides 90 arranged uniformly along the circumference of the depression 330 to form a crown of slides.

Figure 7:
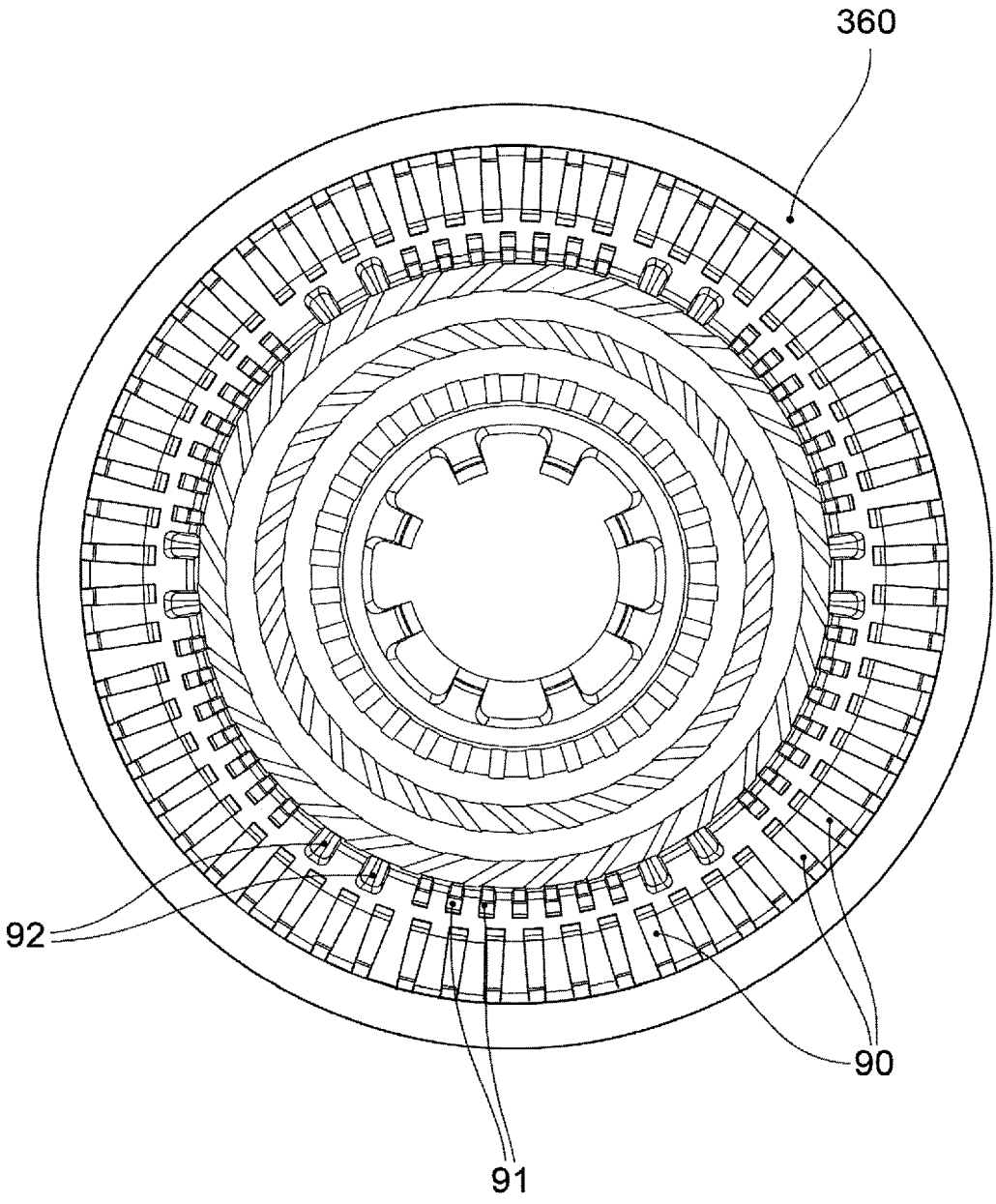
FIG. 7 shows an embodiment variant of the bottom of the capsule of FIG. 6.

In the embodiment variant shown in FIG. 7, in addition to the crown of slides of FIG. 6, the base 33 is provided with a plurality of steps 91 arranged along the circumference of the depression 330 to form a crown of steps. Preferably, the crown of slides is facing staggered to the crown of steps so as to ensure the presence of a circumferential path for the collection and outflow of the infused beverage.

Preferably, the crown of steps is interrupted by the presence of at least one ramp 92 suitable to keep the disc 5 raised during deformation so as to ensure the outflow of the infused beverage inside the labyrinth 30.

In the embodiment variant shown in FIGS. 8 to 11 and 15, the base 33 comprises, in the depression 330, a plurality of supports 350, defined by further reliefs, arranged between the labyrinth 30 and the edge 360.

The supports 350, substantially in the shape of an arc of circumference, are circumferentially arranged homogeneously with respect to the nozzle 32 (and to the central portion 310). Advantageously, the supports 350 are rounded, i.e., radiused or free of sharp edges and/or cutting profiles. This solution further reduces any risk of breakage or tearing of the disc 5.

The supports 350 define a plurality of recesses 351, or compartments. In particular, a recess 351 is defined between a pair of adjacent supports 350. Advantageously, the recess 351 defines a preferential space for the formation of the wrinkle 52. The recess 351 thus directs the formation of the wrinkle, which is formed precisely at the recess 351.

Figure 8:
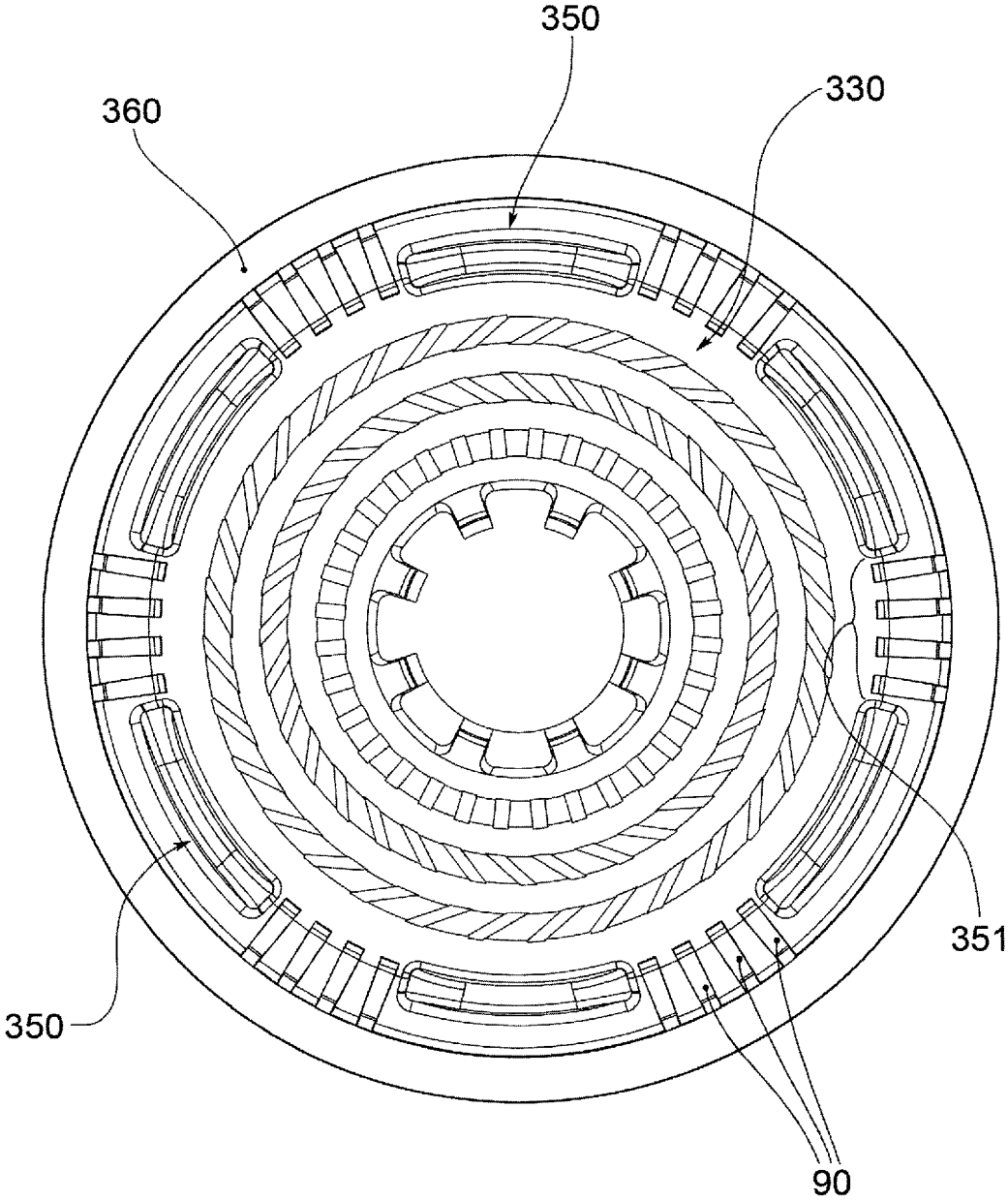
FIG. 8 shows a top view of the internal bottom of a capsule according to this invention, in a further embodiment.

In the embodiment variant shown in FIG. 8, the base 33 is provided with a plurality of slides 90 arranged uniformly in each recess 351, precisely where the wrinkles 52 are formed.

Figure 9:
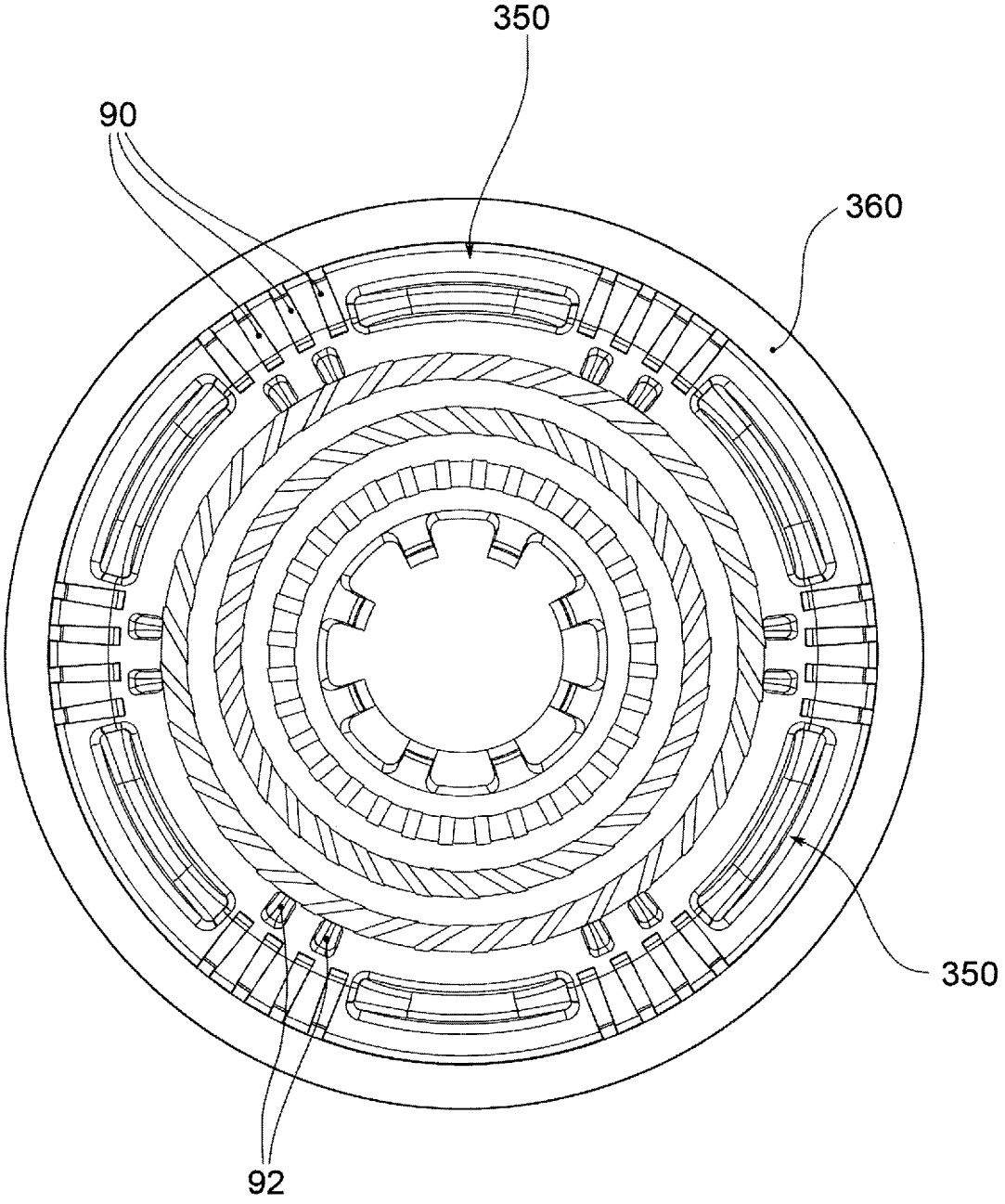
FIG. 9 shows an embodiment variant of the bottom of the capsule of FIG. 8.

In the embodiment variant shown in FIG. 9, in addition to the slides 90 of FIG. 8, the base 33 is provided with at least one ramp 92 arranged in the recess 351. Therefore, also the ramps 92 are provided precisely where the wrinkles 52 are formed, so as to ensure the outflow of the infused beverage in the labyrinth 30.

Figure 10:
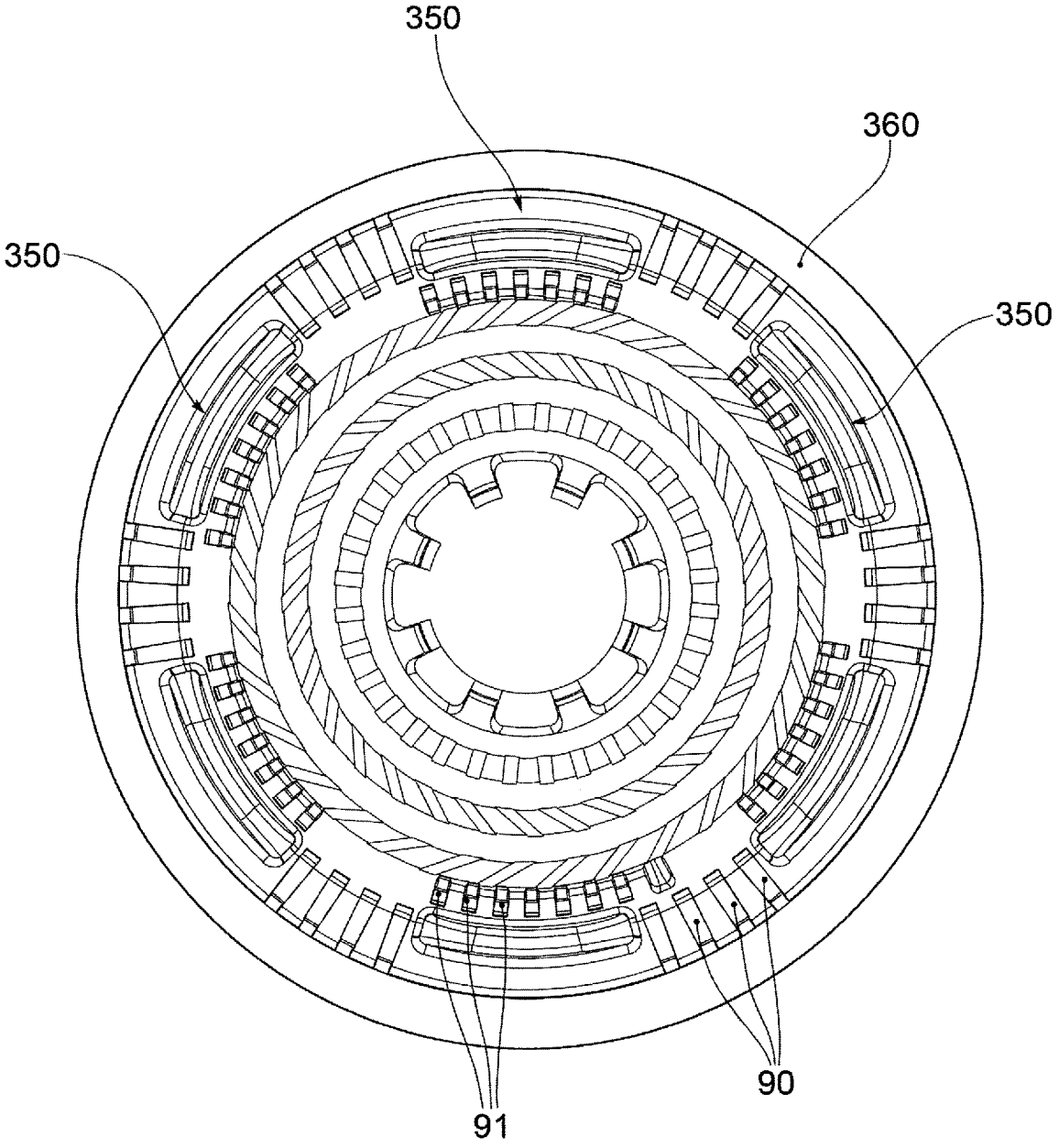
FIG. 10 shows a further embodiment variant of the bottom of the capsule of FIG. 8.

In the embodiment variant shown in FIG. 10, in addition to the slides 90 of FIG. 8, the base 33 is provided with a plurality of steps 91 arranged facing in correspondence of the supports 350. The steps 91 extend towards the supports 350 starting from the labyrinth 30.

Figure 11:
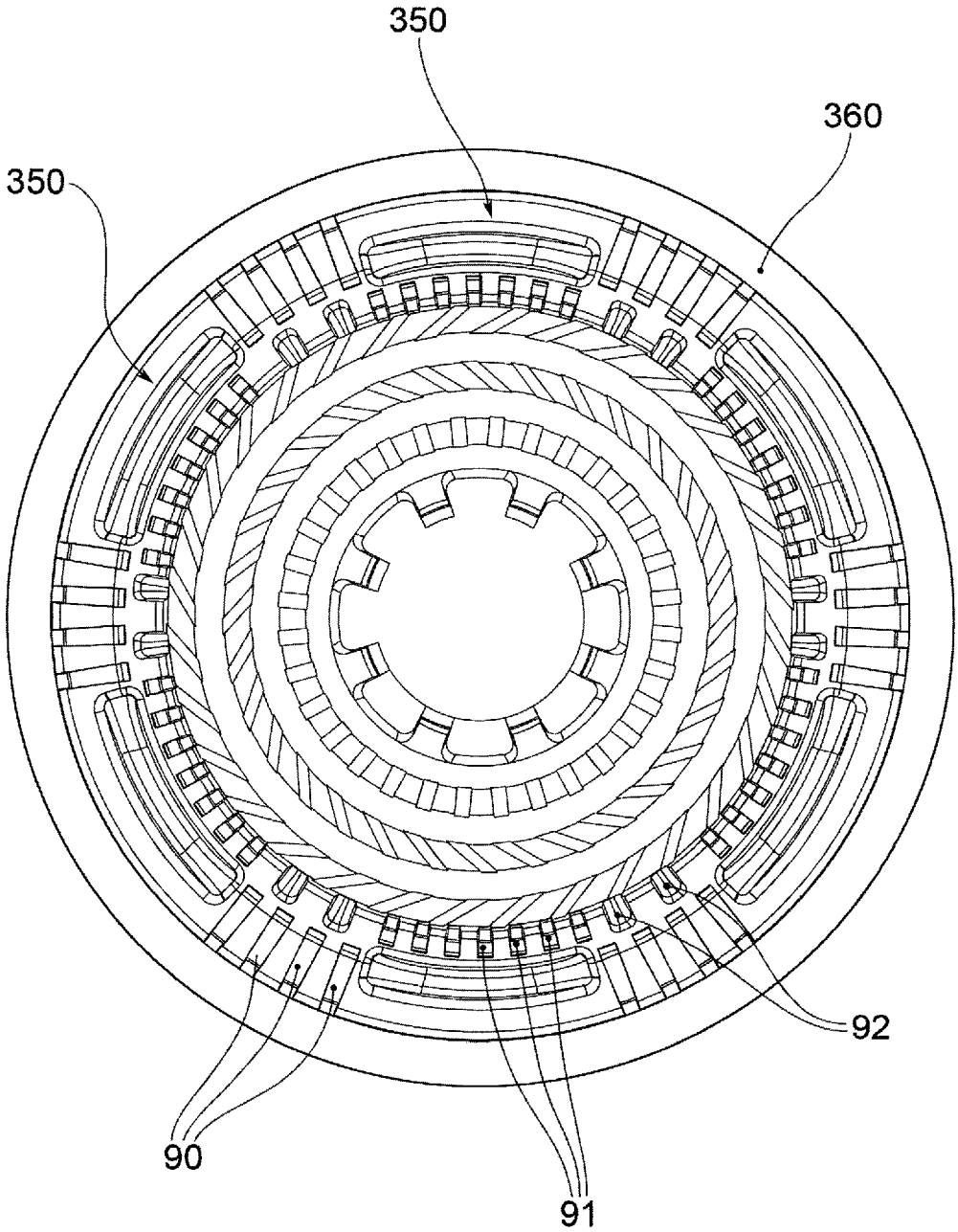
FIG. 11 shows a yet further embodiment variant of the bottom of the capsule of FIG. 8.
Figure 12:
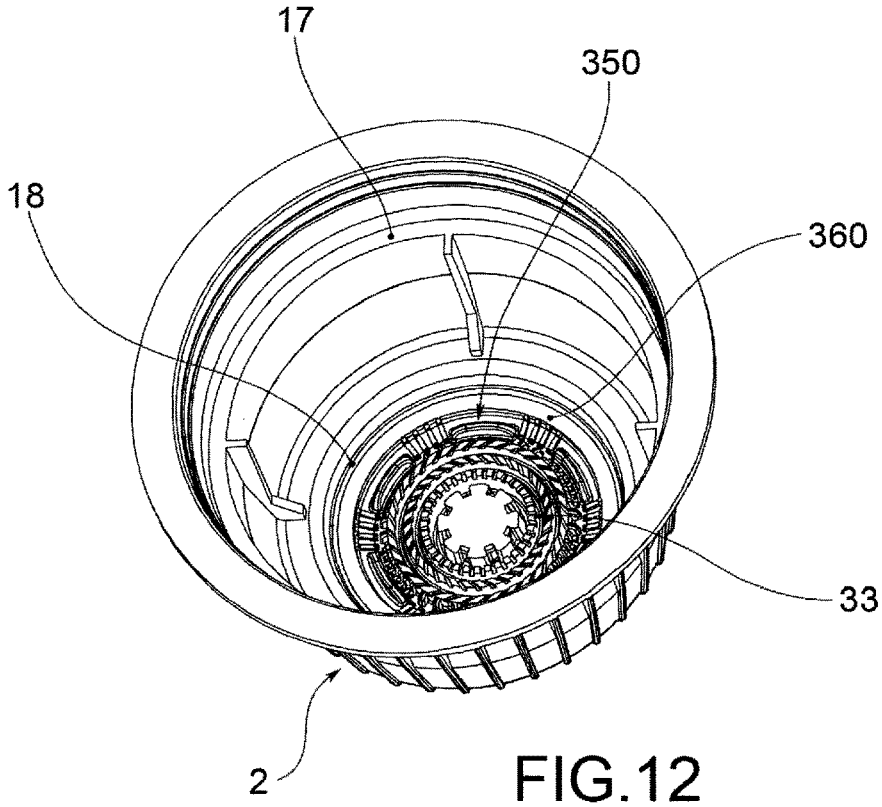
FIG. 12 shows a perspective view from above of a capsule provided internally with a bottom, according to the embodiment variant of FIG. 11.

In the embodiment variant shown in FIG. 11, in addition to the slides 90 and the steps 91 of FIG. 10, the bases 33 is provided with at least one ramp 92 arranged in in the recess 351. This preferred variant ensures both the collection path of the beverage and the flow path in the labyrinth 30.

Figure 15:
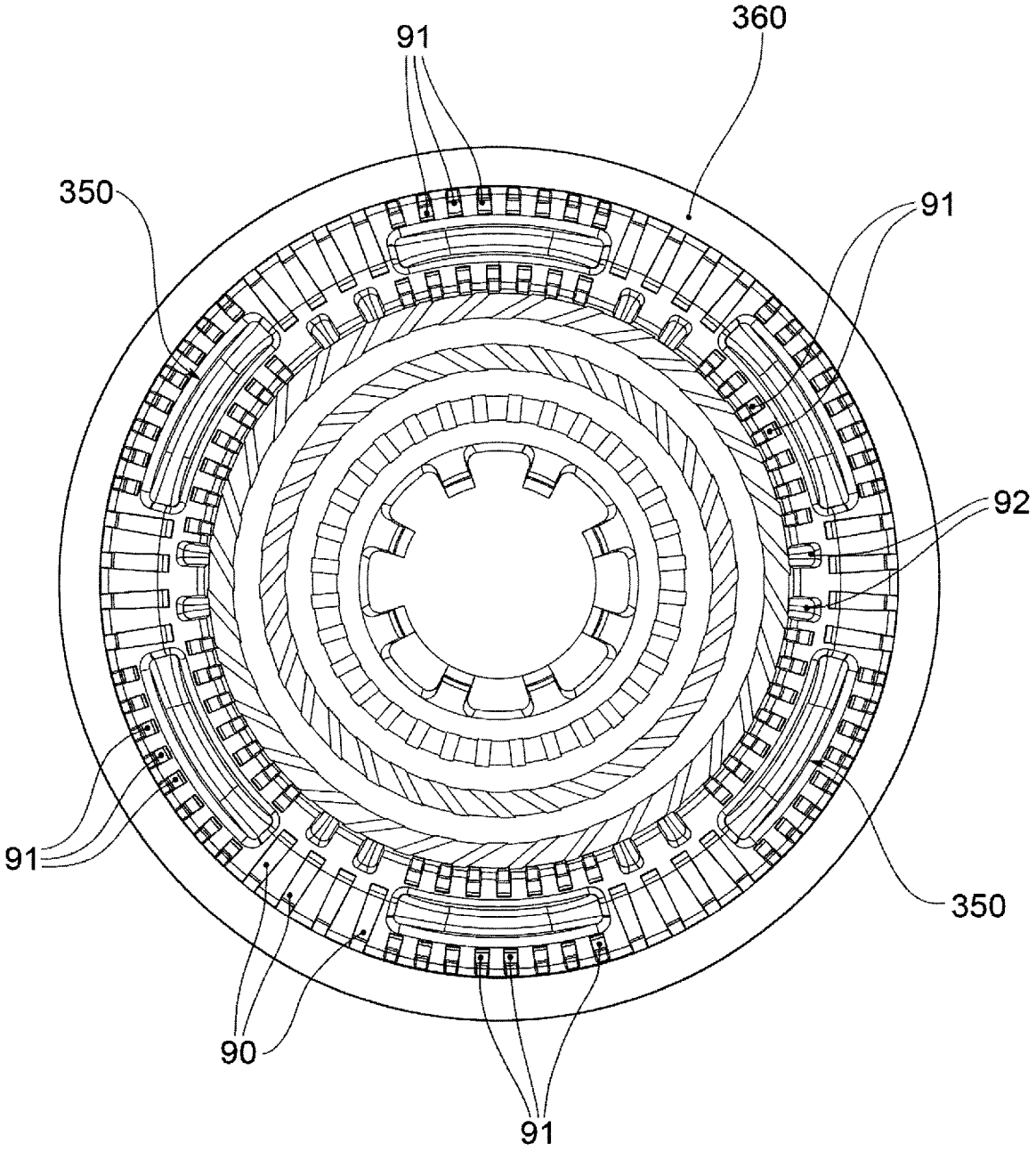
FIG. 15 shows a yet further embodiment variant of the bottom of the capsule of FIG. 11.

In the embodiment variant shown in FIG. 15, in addition to the steps 91 of FIG. 11, the base 33 is provided with further steps 91' arranged facing in correspondence of the supports 350. The steps 91' extend towards the supports 350 starting from the edge 360.

In a preferred embodiment variant, the disc 5 is completely made of plastic. This solution allows obtaining a very elastic disc, suitable to deform freely without tearing. In fact, the traditional capsules are provided with sealing disks made of metallic material, typically aluminium, intended to tear when pierced by puncture means provided on the capsule bottom for opening the capsule itself. So, unlike deliberately rigid and tearable traditional discs, the plastic disc is elastic, strong and deformable (due to the increase of internal pressure of the fluid in the capsule) without tearing. No opening in the wall of the disc 5 is formed due to the increase of the fluid pressure to obtain the outflow of the infused beverage. Even after the opening of the capsule, the disc 5 remains intact.

However, the high elasticity of the plastic disc means that the disc 5 is so deformed to the point of almost completely adhering to the profile of the reliefs 320,360 of the base 33, which profile may be sharp and cause damage to the disc itself. Therefore, in case of use of a completely plastic disc 5, it is essential to have supports 90,91,92, suitable to accompany the deformation of the disc 5 in such a way that it does not tear, break or adhere to the surface of the base 33.

A capsule according to this invention is usable for the packaging of concentrated products (in the form of powder, granules or leaves) in predetermined and disposable doses, for the extemporaneous preparation of beverages such as tea in leaves or soluble, coffee in powder or instant coffee, herbal tea, milk, chocolate, or other dehydrated, water-soluble products.

Innovatively, in a capsule for the preparation of infused or soluble beverages according to this invention, wherein the opening for the outflow of the infused beverage occurs as a result of the deformation of the sealing disc due to the pressure exerted by the fluid, the deformation of the disc does not interfere with the flow passage of the beverage towards the exit nozzle.

Advantageously, in a capsule according to this invention, the supports accompanying the deformation of the disc prevent it from tearing and breaking. Advantageously, the supports have rounded and bevelled profiles to avoid any risk of tearing of the disc, laceration that would interfere with the mechanism of opening by deformation.

Advantageously, in a capsule according to this invention, the supports keep the disc lifted during deformation in such a way that will it will not adhere to the base and a correct and complete outflow of the infused beverage is allowed.

Advantageously, in a capsule for the preparation of infused or soluble beverages according to this invention, the pressurised fluid passes through the substance to be infused in an optimal way with possible effects on the quality of the infused beverage.

It is clear that one skilled in the art may make changes to the capsule for the preparation of infused or soluble beverages described above, all contained within the scope of protection defined by the following claims.

The invention claimed is:

1. A capsule for the preparation of infused or soluble beverages, comprising:

a cup suitable to define an internal volume for containing at least one substance to be infused or dissolved, said cup being closed at the top by a cover, and the cup comprising:

a bottom provided with a central opening for an outflow of an infused beverage, and a base inside the cup at the bottom provided with reliefs projecting in the direction of the cover, said reliefs comprising at least one outer edge and at least one inner relief which define a depression therebetween for collecting the infused beverage;

a disc placed inside the cup, fixed between the internal volume and the reliefs, suitable to seal the capsule at the base;

wherein the disc is peelably fixed on the outer edge so at least a portion of the disc detaches from the outer edge due to an increase of pressure inside the capsule, and wherein the disc deforms due to the pressure exerted by the infused beverage inside the capsule without tearing or breaking the disc to release the infused beverage through the central opening in the bottom of the cup, and wherein the base, in correspondence of the depression, is provided with a plurality of supports provided with a profile decreasing towards the depression, suitable to prevent the deformation of the disc from interfering with the outflow of the infused beverage towards the opening.

2. The capsule according to claim 1, wherein the supports extend in a radial direction from at least one of the reliefs of the base.

3. The capsule according to claim 1, wherein the supports have a maximum height equal to, or less than, the height of an adjacent relief.

4. The capsule according to claim 1, wherein the supports have a minimum height equal to, or higher than, the bottom of the depression.

5. The capsule according to claim 1, wherein the supports have rounded and bevelled profiles and are thus without sharp corners or cutting profiles.

6. The capsule according to claim 1, wherein the supports are arranged facing each other and staggered circumferentially between each other.

7. The capsule according to claim 1, wherein the supports are slides provided inside the depression, extending radially from the outer edge, provided with a maximum height less than the height of the edge and a minimum height above the bottom of the depression.

8. The capsule according to claim 1, wherein the supports are steps provided inside the depression, extending radially from the inner relief toward the outer edge, provided with a maximum height less than the height of the inner relief and a minimum height above the bottom of the depression.

9. The capsule, according to claim 1, wherein the supports are ramps provided inside the depression, extending radially from the inner relief toward the outer edge, provided with a maximum height about equal to the height of the inner relief.

10. The capsule according to claim 1, wherein the base comprises, inside the depression, a plurality of arc-shaped supports in the shape of an arc of circumference, in which a recess is defined between a pair of adjacent arc-shaped supports, and wherein the base is provided with at least one slide arranged in the recess.

11. The capsule according to claim 10, wherein the base is provided with at least one step arranged facing in correspondence of each arc-shaped support.

12. The capsule according to claim 10, wherein the base is provided with a ramp arranged in the recess.

13. The capsule according to claim 1, wherein the disc is multilayer plastic and wherein the lower layer of the multilayer plastic disc is made of a material compatible with a material of the cup.

14. The capsule according to claim 13, wherein the cup is made of polypropylene and the lower layer of the disc is peelable polypropylene.

15. The capsule according to claim 11, wherein the base is provided with a ramp arranged in the recess.

* * * * *